United States Patent [19]

Wilkins et al.

[11] 4,307,661

[45] Dec. 29, 1981

[54] PRINTER WITH SHEET FEEDER HAVING REGISTERING STATION AND SUCTION CONVEYOR

[75] Inventors: David R. G. Wilkins, Wistaston, Near Crewe; Roger Walker, Nantwich; Donald G. Billington, Bignall End, all of England

[73] Assignee: McCorquodale Machine Systems Limited, Basingstoke, England

[21] Appl. No.: 76,806

[22] Filed: Sep. 18, 1979

[30] Foreign Application Priority Data

Apr. 20, 1979 [GB] United Kingdom ..... 13793/79

[51] Int. Cl.[3] ..... B41J 13/08; B41J 13/28

[52] U.S. Cl. ..... 101/93.01; 101/93.28; 101/242; 101/287; 271/197

[58] Field of Search ..... 101/57, 69, 78, 79, 101/80–82, 93, 93.01, 93.11, 93.18, 93.28, 93.29, 93.3, 93.31, 93.32–93.34, 99, 110, 232, 95, 193, 242, 287, 316–321, 407 R, 407 BP; 400/627, 629; 271/194, 195, 196, 197, 234, 245; 198/689; 355/76, 89, 91

[56] References Cited

U.S. PATENT DOCUMENTS

| | | | |
|---|---|---|---|
| 3,194,154 | 7/1965 | McKeag | 101/93.28 X |
| 3,527,166 | 9/1970 | Daffa | 101/407 BP |
| 3,644,812 | 2/1972 | Bitto | 400/902 X |
| 3,648,605 | 3/1972 | Hottendorf | 271/197 X |
| 3,812,779 | 5/1974 | Cobb | 101/115 |
| 4,015,523 | 4/1977 | Evans et al. | 101/242 X |

FOREIGN PATENT DOCUMENTS

| | | | |
|---|---|---|---|
| 1202118 | 9/1965 | Fed. Rep. of Germany | 271/197 |
| 1024566 | 3/1966 | United Kingdom . | |
| 1176575 | 1/1970 | United Kingdom . | |
| 1210989 | 11/1970 | United Kingdom | 101/232 |
| 1328148 | 8/1973 | United Kingdom . | |
| 1428011 | 3/1976 | United Kingdom . | |
| 1433442 | 4/1976 | United Kingdom | 101/232 |

*Primary Examiner*—Edgar S. Burr

*Attorney, Agent, or Firm*—Kemon & Estabrook

[57] ABSTRACT

To print on each of a number of sheets, the sheets are advanced, preferably in underlapped form, up to registering stops. When a sheet has been registered at the stops, suction is applied to an underlying conveyor, the stops are withdrawn and the sheet is advanced in steps to a printing station, the sheet being held in register by suction during this advancement. Printing takes place while the sheet is stationary and still held in register, between steps of movement. Suction may be switched on and off at the registering station by means of a movable perforated switch plate, the perforations of which are aligned, in a first position of the switch plate, with suction-conveying perforations in another plate or belt; in a second position of the switch plate its perforations are misaligned with the perforations in the other plate or belt, preventing the application of suction to an overlying sheet. A suction conveyor may also be used to convey a web from a first station at which an operation is performed thereon to a second station at which another operation is to be performed thereon in register with the first operation.

5 Claims, 11 Drawing Figures

11a 16
11a
11b 11a
11b 16
11a
11b 36
26
20
34
18
32
32
14
30
12
28
10

PRINTER WITH SHEET FEEDER HAVING REGISTERING STATION AND SUCTION CONVEYOR

This invention relates to performing operations on sheets or on a web in a given condition of register with respect to edges of these sheets or other operations performed on the sheets or web.

In some operations, it is essential to maintain a high degree of accuracy in the position at which operations are carried out on sheets or webs. An example is the printing of machine-readable data on cheques. If the line of print is not exactly in the right place in relation to the cheque edges, it will give false results or will be rejected when subsequently placed in an automatic cheque reading machine.

A method according to the present invention for printing on each of a number of sheets, comprises advancing each sheet in turn up to a front-registering station and registering the sheet for front lay, the sheet being registered for side lay either at the front lay registering station or prior to arrival at the front lay registering station, applying vacuum to hold the registered sheet on a conveyor portion which underlies the sheet at the registering station and advancing the registered sheet in a series of steps to a printing station, the sheet being continuously held in register on the conveyor by suction between the front lay registering station and the printing station, and printing on each registered sheet while it is substantially stationary, following a step of advancement, and while it is still held in register on the conveyor.

In cheque printing, it is convenient to print several cheques (for example five) on a single sheet, the cheques being subsequently separated and formed into books. In such a case, the sheets are advanced up to the front-registering station and thence to the printing station in a series of steps, each of which is shorter than the length of the sheet in the direction of advancement; if each cheque carries a single line of print, the steps of advancement will be equal to the cheque pitch.

It is convenient to feed the sheets to the registering station in underlapped form. The final stage of advancement up to the registering station may be effected by a suction conveyor, the suction being removed when the leading edge of a sheet reaches the registering station to enable the sheet to be registered for front lay. Advantageously, while the leading edge of this sheet is being registered at the registering station, and while other sheets upstream of the registering station are stationary, previously registered sheets are advanced towards the printing station, thereby removing the underlap. In this way, the underlapped sheets are converted, in effect, to a web of registered sheets on the suction conveyor, each sheet progressing in a series of steps to the printing station. The suction conveyor may be in the form of a number of separate sections, the gap between successive sections being sufficiently narrow to be spanned by a single sheet, to avoid loss of registration of the sheet as it passes from one section to the next.

The suction conveyor may consist of a perforated endless belt running over a fixed perforated sheet overlying a suction source, perforations in the endless belt and in the fixed sheet being such that at all times in the movement of the endless belt there is sufficient alignment of the perforations to ensure the application of suction to a web or sheet carried on the endless belt.

Alternatively, either or both of the fixed sheets of the suction conveyor and the moving belt may be made of porous material such as porous plastics sheeting or sintered metal, for example.

To achieve a rapid sheet feed, it is necessary to switch the suction for the suction conveyor at the registration stops very rapidly. In one advantageous form of the invention, in a method in which sheets are transported on a suction conveyor up to registration stops and the suction is removed from the conveyor while registration takes place and in which the stops are then moved out of the sheet path and suction is switched on again to permit the conveyor to advance the sheet to a printing position, the switching of the suction is effected by moving a further perforated sheet between first and second positions relative to the fixed perforated sheet; in the first position, the holes of the said perforated sheet register with those of the fixed perforated sheet and suction is effective and in the second position the holes of the two sheets are out of alignment, the suction souce is blocked and suction is no longer applied to the sheets.

This way of switching suction on and off is advantageous in that the perforated sheet which constitutes the "switch" is located immediately under the sheet track; consequently there is no delay between the operation of the suction switch and application or removal of suction from the sheets, as there is when suction is controlled by a valve at a point more distant from the sheet track.

According to a further aspect of the invention, in a method of effecting an operation on a web, the operation being registered in relation to an earlier operation performed on the web, the web is conveyed by means of a suction conveyor from the position at which the preceding operation was performed on the web to the position at which the later operation is to be carried out, whereby the later operation is effected in a given condition of register in relation to the earlier operation. Because the web position on the conveyor is maintained accurately by the suction acting on the web, register is assured without the need for sprocket holes to be provided. As the making of accurately formed sprocket holes in an expensive operation, the provision of the suction conveyor to transport the web results in a considerable cheapening of the cost of the web. Furthermore, the normal wastage which arises from the necessity of providing leaders and trailers for the web is eliminated.

In order that the invention may be better understood, some examples of apparatus embodying the invention will now be described with reference to the accompanying drawings, in which:

FIG. 1 shows the successive sections of the sheet conveyor system;

FIGS. 2*a* to 2*d* illustrate successive stages of sheet feeding and FIG. 2*e* illustrates the track sections underlying the sheets shown in FIGS. 2*a* to 2*d*;

Figure 1:
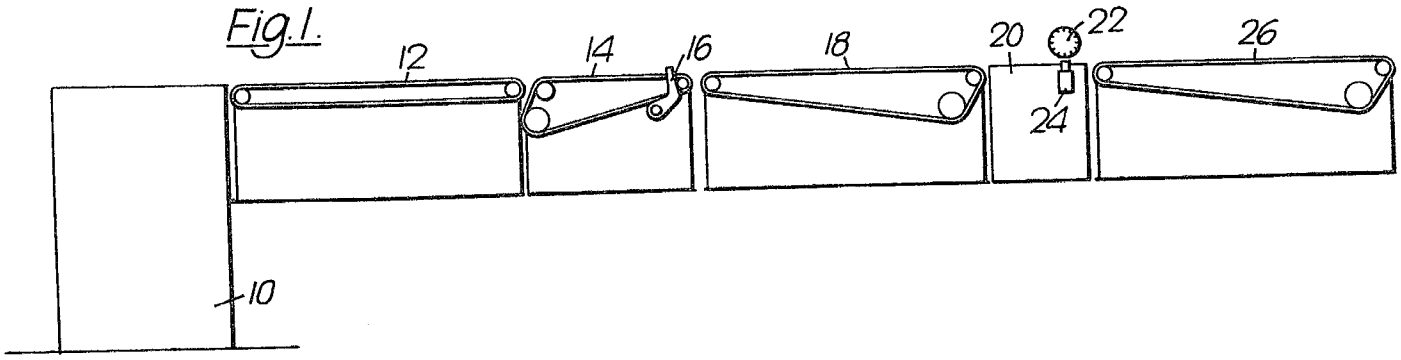

FIG. 1 shows printing apparatus in which paper sheets are fed from a paper feed section 10 on to a first section of conveyor track 12. They then pass to a suction conveyor track 14 which includes front registration stops 16. The registered sheets, now arranged in a nose-to-tail fashion, then pass over a further suction conveyor section 18 to a printing station 20. The sheets are advanced, in steps equal to one printing pitch, past a printing wheel 22 and hammer 24. The printed sheets are then advanced on to an exit track 26.

Figures 2A, 2B, 2C, 2D, 2E:
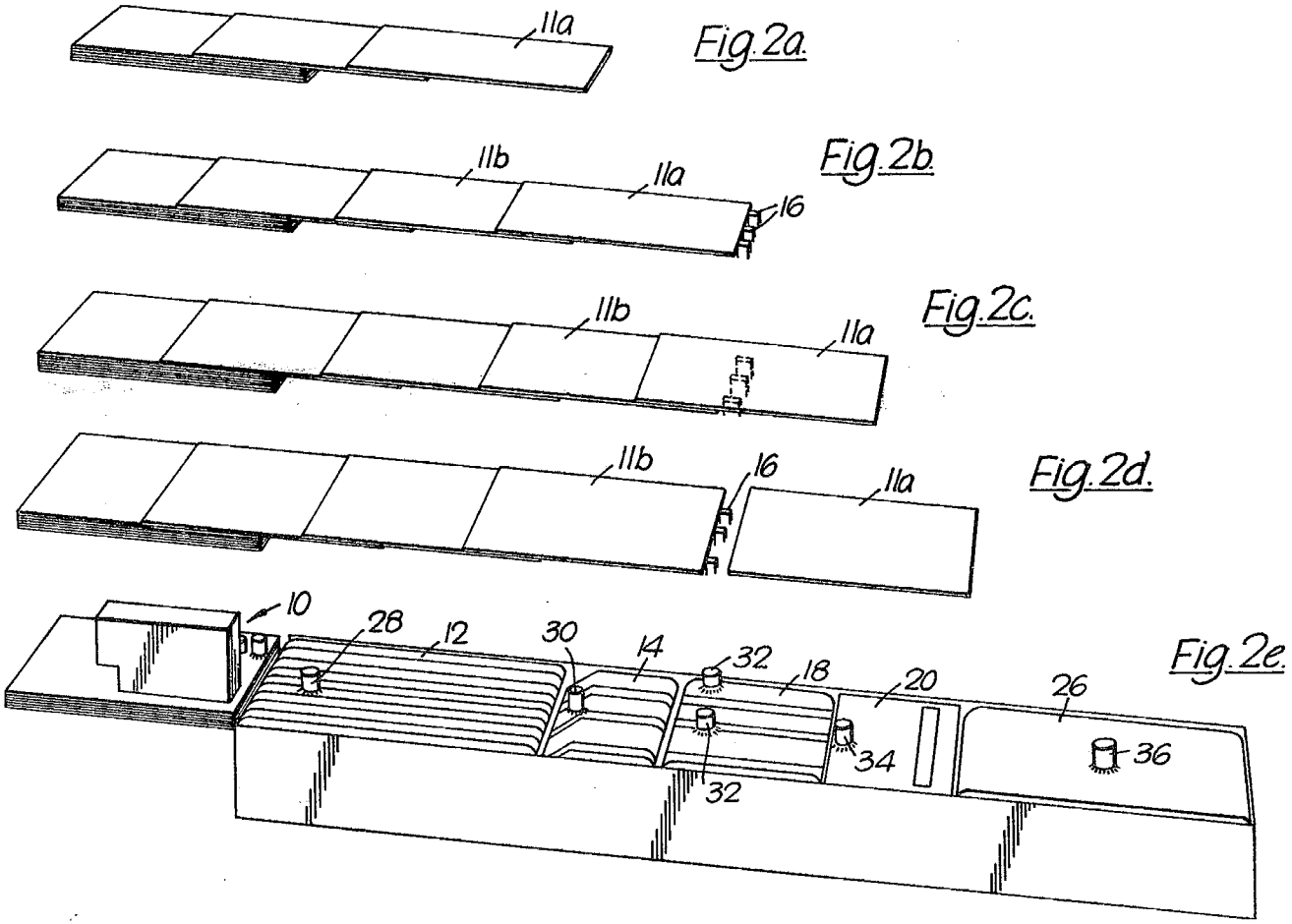

In this apparatus, the sheets are initially underlapped when they are fed from the stack, the underlapping being removed at the register stops. The manner in which this is done is illustrated in FIG. 2 of the accompanying drawings. Referring first to FIG. 2*e*, a stepping motor provides the drive for the tracks 12, 14, 18 and 26; the stepping motor is coupled through a clutch to tracks 12 and 14.

FIG. 2*a* illustrates the transfer of sheets 11 from a stack of sheets at the paper feed section on to track 12 (FIG. 2*e*) in underlapped form. Since no sheet has yet reached the register stops 16, the clutch is activated continuously. For each cycle of the machine each sheet is moved forward substantially through one document pitch. A track paper detector 28 provides an indication that sheets of paper have been transferred to track 12.

In FIG. 2*b*, the first sheet 11*a* has reached the registration station. Its presence has been detected by a detector 30 and as a consequence registration fingers 16 have been energised and raised into the path of the sheet. The sheet 11*a* is overdriven into these fingers, giving front edge registration. The over-driving is obtained by arranging that the distance between the feed point and the register point is less than an integral number of document pitches. The clutch is then de-energised and the brake is activated, thereby removing drive from tracks 12 and 14.

On the next cycle, side lay is obtained by known means; alternatively, if the track 12 is not a suction conveyor but comprises for example tapes and rollers, side lay registration may be provided during the passage of the sheet along the track 12.

During this cycle, any sheets which have already passed the registration stops are given a step of movement.

On the next machine cycle, the clutch is activated and the brake and registration fingers are de-energised. The last-registered sheet then leaves the registration section and enters track 18. As it does so, a check is made on skew by means of detectors 32.

In FIG. 2*c*, the arrival of the next sheet 11*b* has been sensed and the register fingers 16 have been raised. The tail of the leading sheet 11*a* is lifted by the fingers but it is still free to move forward and is still held in register by the suction at track 18. During the next machine cycle, when the clutch is de-energised and the brake activated, the sheet 11*b* abutting the register fingers is side laid while the already registered sheet 11*a* is given a step of advancement, together with any sheets ahead of it between the registration and printing stations. This is shown in FIG. 2*d*. In the example shown, a small gap (about 3 mm.) is left between the sheets. The leading end of the first sheet 11*a* has now reached the printing position and a line of print is impressed upon it each time it is stationary between steps of advancement. A detector 34 senses the presence of paper at the printing station and a detector 36 senses the presence of paper from the delivery track.

Thus, once a sheet has been registered for front lay against the register fingers 16 and for side lay, it is maintained under the control of the suction conveyors during its passage through the printing station and in this way register is maintained, both for front lay and for side lay.

Figure 3:
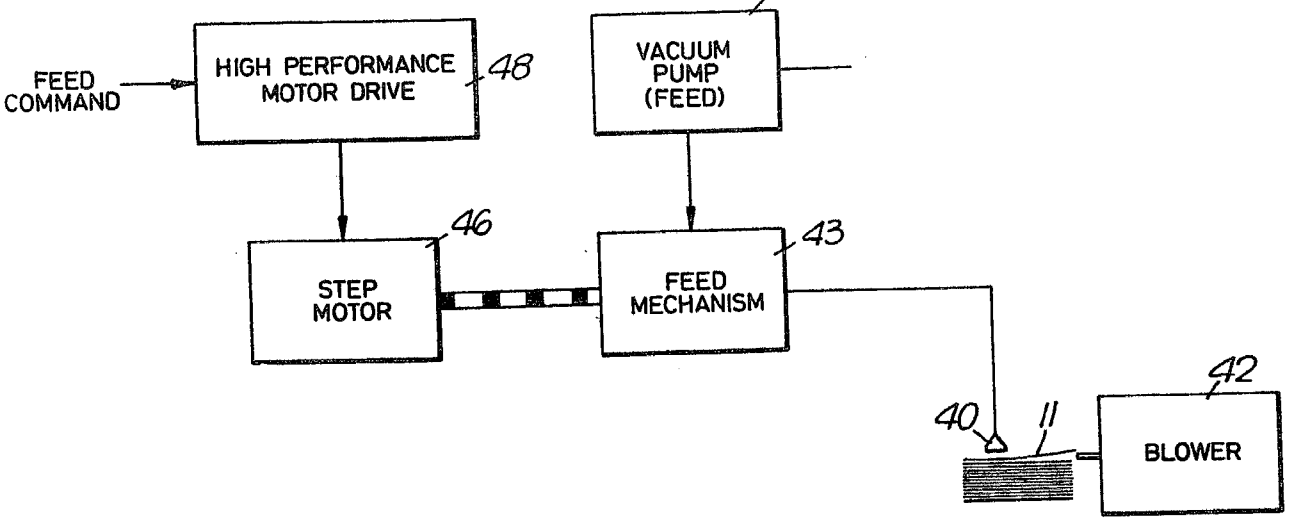
FIG. 3 shows apparatus for removing the sheets from a stack.

FIG. 3 shows diagrammatically the manner in which sheets are removed from a feed table one by one. A suction head 40 acts on the uppermost of the sheets 11, the separation of the sheets being aided by a blower 42. A feed mechanism 43 applies suction to the head 40 from a vacuum pump 44 and feeds the suction head and uppermost sheet forward under the control of a stepping motor 46 energised by a high performance driving circuit 48.

FIG. 3 illustrates the conveyor apparatus which forwards the sheet through the registration and printing stations. The feed mechanism operates in a known three-cycle mode. In the first cycle in response to a feed command the vacuum feeder picks up the top sheet by the tail; in the second cycle it moves the sheet forward on to the first track section, underlying the preceding sheet. On the third cycle the suction head returns to its rest position.

Figure 4:
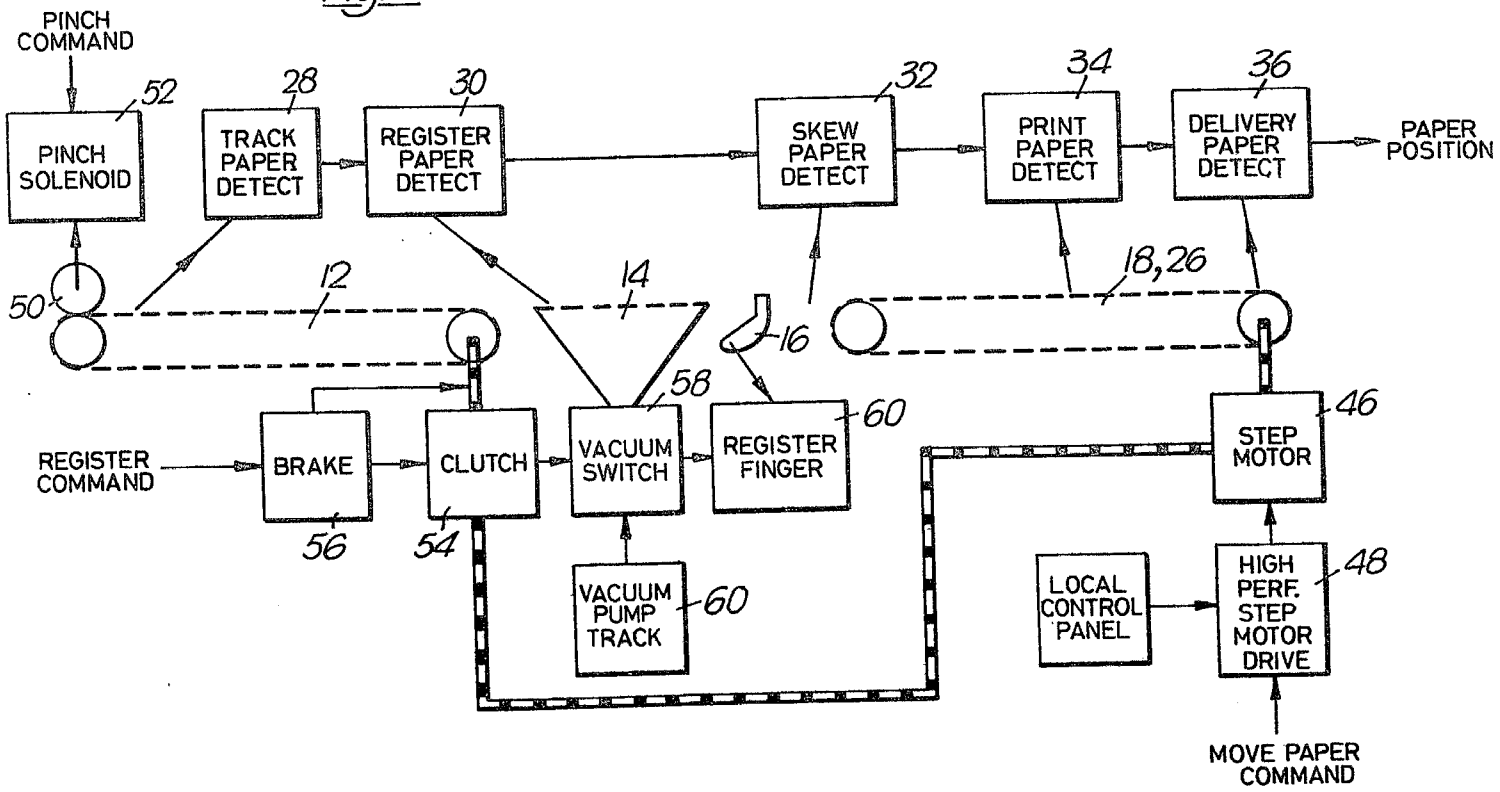
FIG. 4 is a block diagram of the track drive and detection means.

FIG. 4 is a block diagram of the track drive and detection systems in diagrammatic form; track 14 is in fact of the form indicated in FIG. 1 and the conveyors 18 and 26 of FIGS. 1 and 2 are shown as a single conveyor in FIG. 4. A sheet of paper fed forward by the apparatus shown in FIG. 3 is transferred to track section 12 by means of pinch rollers 50. These are normally in contact, moving the paper in cyclic fashion as required. When a new sheet is added to the stream by the feeder, the pinch rollers are moved apart by a solenoid 52, allowing the sheet to enter. To avoid possible slip problems, it is arranged that the pitch solenoid actuator is active only at times when the paper stream is stationary. As stated above, the track section 12 need not be a suction conveyor; the sheets can be held in place on this track section by tapes. This track section, like the suction track section 14, is driven from the stepping motor 46 through a clutch 54 and under the control of a brake 56, the clutch being actuated in the dead period, when the stepping motor is stopped. When the clutch is de-energised the brake is on and vice versa. From track section 12, the sheet passes to the registration station and on to the suction track section 14. The vacuum switch 58, through which suction from a pump 60 is applied to track section 14, will be described more fully later. The position of the register fingers 16 is governed by a register finger control block 60 in synchronism with the switching of the vacuum.

The skew detector 32 comprises two photocells in line at right angles to the track (see FIG. 2*e*). Arrival of the front edge of a sheet at each of these cells is detected, comparison of the times of arrival indicating whether skew is present. If it is, either the operator is warned or the printing section is disabled to prevent printing on the skewed sheet.

Registered sheets pass on to suction conveyor section 18, where printing takes place, and thence to the exit conveyor.

Figure 5:
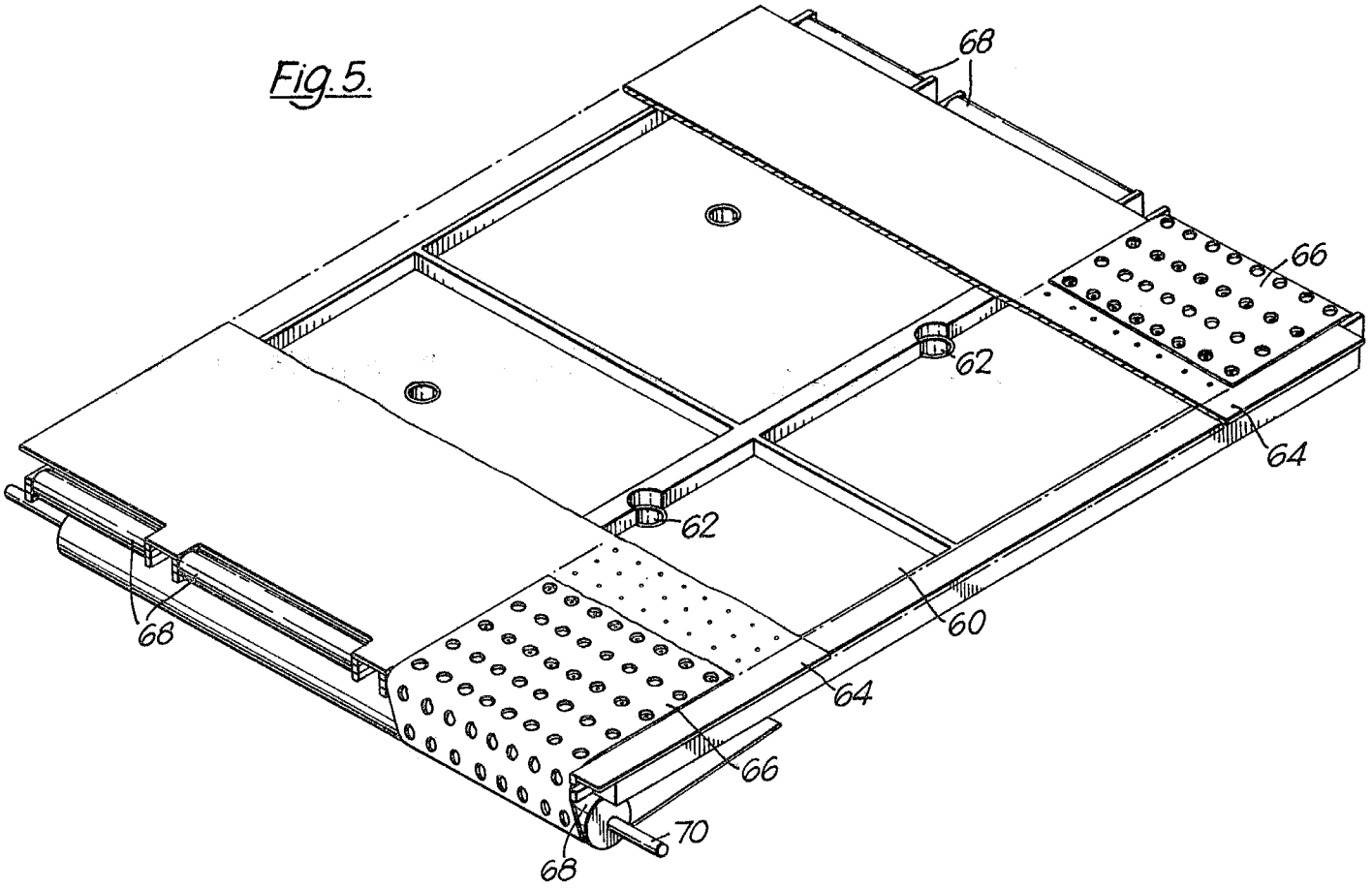
FIG. 5 shows a portion of a suction conveyor suitable for use in apparatus embodying the invention.

FIG. 5 illustrates a portion of the suction conveyor. The track base is divided into sections 60 each with its own vacuum port 62. This base is covered by a track plate 64 formed with small holes on a 1.25 cm. longitudinal pitch. Endless vacuum belts 66 run on rollers 68 over the vacuum track, the shaft 70 for one of the rollers 68 being coupled to the stepping motor. The endless vacuum belts (only one of which is shown in the drawing) are formed with holes larger in diameter than the holes in the vacuum belt and at a longitudinal pitch such that one row in three of the track plate rows lines up with a row of holes in the vacuum belt.

Figure 6:
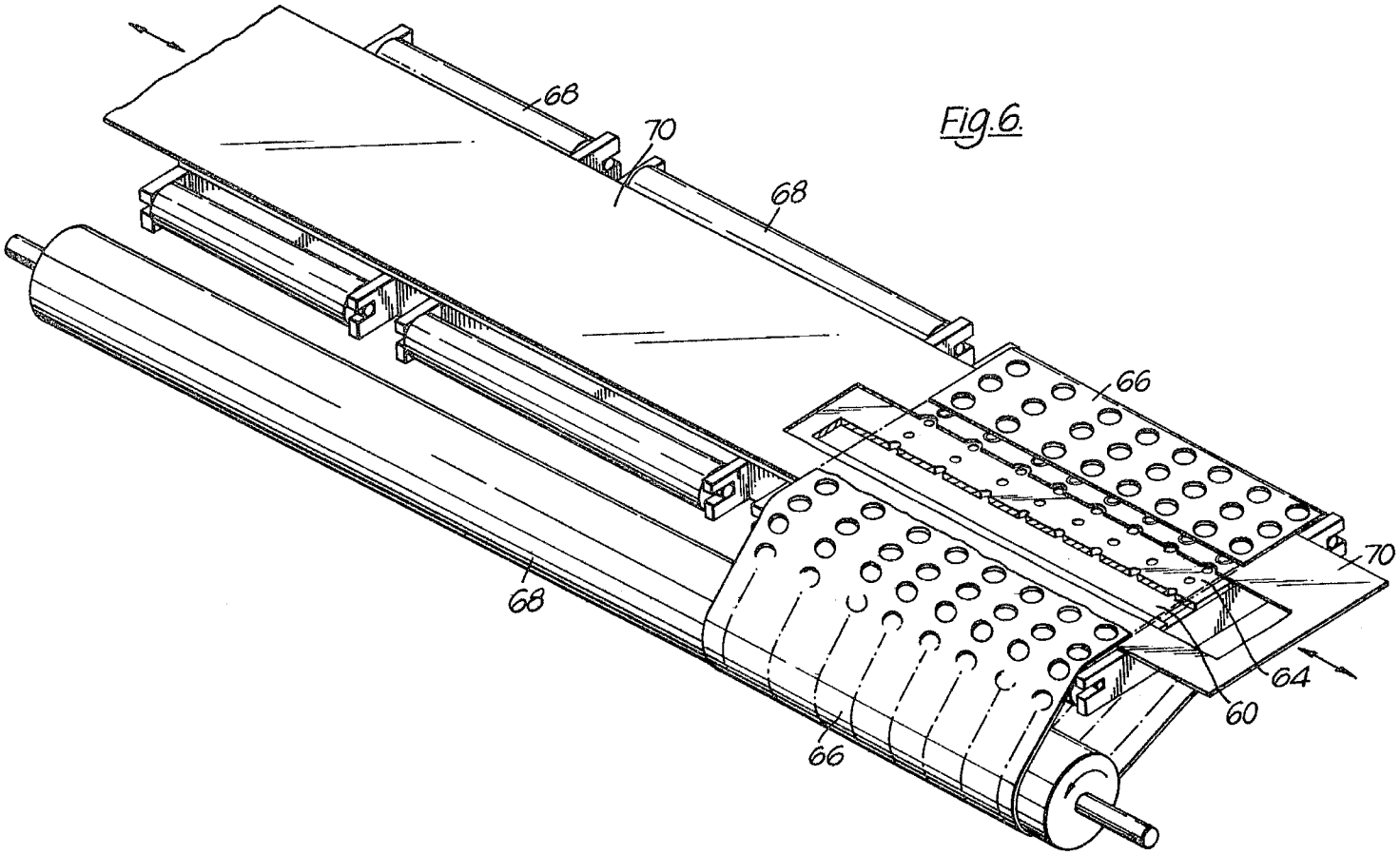
FIG. 6 shows a vacuum switch suitable for use in apparatus embodying the invention.

The manner in which the vacuum switch is arranged will now be described with reference to FIG. 6. As in FIG. 5, a vacuum chamber 60 is covered by a vacuum track plate 64. In this case, however, a vacuum cut-off plate 70 is arranged between plate 64 and the endless belt 66. The plate 70 is laterally movable by one-half of the transverse pitch of the holes. In one extreme position of movement, the holes in plate 70 are aligned with the holes in plate 64 and suction is therefore applied through the holes in endless belt 66. In the other extreme position, the holes in cut-off plate 70 are midway between rows of holes in plate 64 and the vacuum in chamber 60 is isolated from belt 66. This way of switching vacuum on and off, in which the "switch" is located immediately under the sheet track, ensures that there is no delay between the operation of the vacuum switch and the application of suction to or removal of suction from the sheets, as there is when vacuum is controlled by a valve at a point more distant from the sheet track.

If desired, the perforated belt on which the sheets are transported may be replaced by a porous belt. Alternatively, the track plate immediately above the vacuum chambers can be of porous material instead of perforated material, the misalignment of the holes in the vacuum cut-off plate and holes in the vacuum belt preventing the application of suction to the sheets where necessary.

Figure 7:
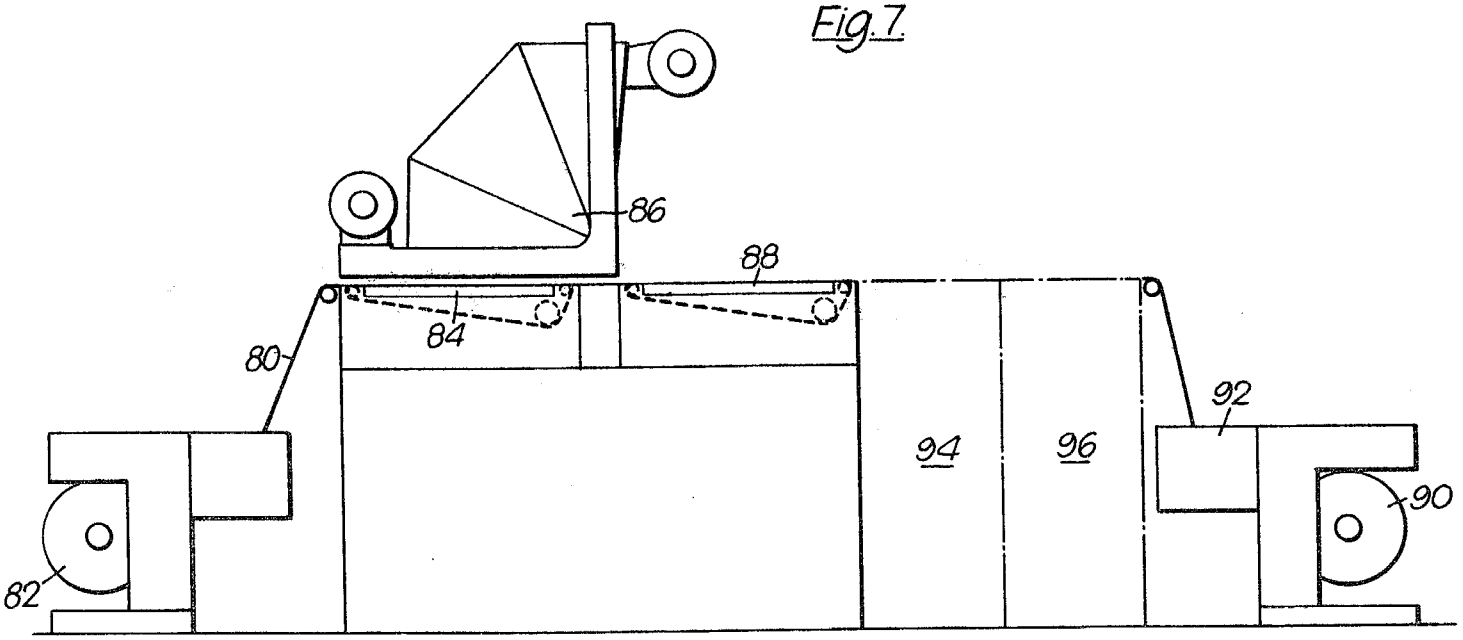
FIG. 7 shows a web transporting and printing apparatus embodying the invention.

Finally, FIG. 7 illustrates the application of suction conveyor feeds to a web transporting and printing system. A web 80 is fed from a spool 82 on to a suction conveyor track 84 and under the hammer of a printing machine 86. It then passes on to an output suction conveyor track 88 and so to a rewind spool 90 by way of a web loop control device 92. If desired, guillotine and collator units may be installed in the spaces 94 and 96.

We claim:

1. A method of printing on each of a number of sheets, comprising providing a front-registering station, sheet conveyor means upstream of and downstream of the front-registering station, and conveyor advancing means including a stepping motor and a clutch through which the motor is coupled to the conveyor means upstream of the registering station, and a printing station to which the sheet is advanced from the front-registering station on the conveyor means, and further comprising the steps of:

taking the sheets from a stack one by one by a suction feeder operating on the rear of each sheet and feeding the leading edge of each sheet forward on to the conveyor before the trailing edge of the preceding sheet has cleared the stack, whereby the said leading edge underlies the end of the preceding sheet on the conveyor;

applying suction to the conveyor means and advancing each sheet in turn up to the front-registering station, removing the suction to permit front registration to be achieved and registering the sheet for front lay;

registering the sheet for side lay prior to removal of the sheets from the front lay registering station;

applying suction to hold the registered sheet on a portion of the conveyor means which underlies the sheet at the registering station;

following the arrival of each sheet at the registering station, disabling the clutch to hold sheets stationary upstream of the registering station, while the last registered sheet is advanced to remove the underlap, and advancing each registered sheet step by step in the same direction from the front lay registering station to the printing station while continuously holding it in register on the conveyor by suction;

and printing on each registered sheet while it is substantially stationary at the printing station, following a step of advancement, while it is still held in register on the conveyor and without a further registering operation.

2. A method in accordance with claim 1, comprising actuating the clutch while the stepping motor is stationary.

3. A method in accordance with claim 1 or 2, comprising providing a brake to be applied to the sheet-carrying conveyor which is driven through the clutch, applying the brake when the drive is disconnected and removing the brake when the drive is reconnected.

4. A method of printing on each of a number of sheets comprising providing a front-registering station, a sheet conveyor having portions upstream of and downstream of the front-registering station, the sheet conveyor portion upstream of the front-registering station consisting of a moving porous or perforated belt, a fixed perforated plate below the moving conveyor belt and a vacuum chamber below the fixed perforated plate, a switch including a plate formed with holes and lying between the moving conveyor belt and the fixed perforated plate for controlling the application of vacuum to the moving conveyor belt, and a printing station to which the sheet is advanced from the front-registering station on the downstream conveyor portion, the method comprising the steps of:

advancing each sheet in turn up to the front-registering station and selectively applying suction to and removing suction from the sheet at the front-registering station by moving the switch plate to selectively align and misalign the holes in the switch plate with the holes in the fixed perforated plate;

registering the sheet for front lay at the front-registering station with the said holes misaligned;

registering the sheet for sidelay prior to removal of the sheets from the front lay registering station;

moving the switch plate to align the said holes and apply suction to hold the registered sheet on a portion of the conveyor which underlies the sheet at the front registering station;

moving the downstream conveyor portion step by step in the same direction to advance the registered sheet in a series of steps to the printing station and continuously holding the sheet, by suction, in register on the downstream conveyor portion between the front lay registering station and the printing station;

and printing on each registered sheet while it is substantially stationary at the printing station, following a step of advancement, while it is still held in register on the conveyor and without a further registering operation.

5. A method of printing on each of a number of sheets, comprising providing a front-registering station, a sheet conveyor having portions upstream of and downstream of the front-registering station, the sheet conveyor portion upstream of the front-registering station consisting of a moving belt, formed with holes in rows parallel to the direction of belt movement, a vacuum chamber below the moving belt, a fixed porous plate between the moving belt and the vacuum chamber, and a suction switch including a plate formed with holes and lying between the moving conveyor belt and the porous plate for controlling the application of a vacuum to the moving conveyor belt, and a printing station to which the sheet is advanced from the front-registering station on the downstream conveyor portion, the method comprising the steps of:

advancing each sheet in turn up to the front-registering station and selectively applying suction to and removing suction from the sheet at the front registering station by moving the switch plate to selectively align and misalign the rows of holes in the switch plate with rows of holes in the conveyor belt;

registering the sheet for front lay at the front registering station with the said holes misaligned;

registering the sheet for sidelay prior to removal of the sheets from the front lay registering station;

moving the switch plate to align the said holes and apply suction to hold the registered sheet on a portion of the conveyor which underlies the sheet at the front registering station;

moving the downstream conveyor portion step by step in the same direction to advance the registered sheet in a series of steps to the printing station and continuously holding the sheet, by suction, in register on the downstream conveyor portion between the front lay registering station and the printing station;

and printing on each registered sheet while it is substantially stationary at the printing station, following a step of advancement, while it is still held in register on the conveyor and without a further registering operation.

* * * * *